US008973167B2

(12) United States Patent
Yeh

(10) Patent No.: US 8,973,167 B2
(45) Date of Patent: Mar. 10, 2015

(54) INVENTED FACE DECORATION MASK

(76) Inventor: Chia-Chin Yeh, Taipei (TW)

( * ) Notice: Subject to any disclaimer, the term of this patent is extended or adjusted under 35 U.S.C. 154(b) by 605 days.

(21) Appl. No.: 13/214,240

(22) Filed: Aug. 22, 2011

(65) Prior Publication Data

US 2013/0047315 A1 Feb. 28, 2013

(51) Int. Cl.
*A42B 1/18* (2006.01)
*A41G 7/00* (2006.01)

(52) U.S. Cl.
CPC ..... *A41G 7/00* (2013.01)
USPC ..... 2/206; 2/9; 446/27

(58) Field of Classification Search
CPC ..... A41G 7/00; A41G 7/02
USPC ..... 2/206, 15, 11–13, 426–429, 431–432, 2/438–439, 441–454; 351/63, 123, 351/118–119, 113, 121, 120; 446/27
See application file for complete search history.

(56) References Cited

U.S. PATENT DOCUMENTS

| | | | | | |
|---|---|---|---|---|---|
| 509,967 | A * | 12/1893 | Sumner | 351/119 |
| 2,172,959 | A * | 9/1939 | Hirtenstein | 2/13 |
| 3,549,346 | A * | 12/1970 | Savage | 71/11 |
| 3,907,410 | A * | 9/1975 | Richmond et al. | 351/119 |
| 4,790,645 | A * | 12/1988 | Gish | 351/119 |
| 2002/0003604 | A1 * | 1/2002 | Yaguchi | 351/122 |

* cited by examiner

*Primary Examiner* — Danny Worrell
*Assistant Examiner* — Khaled Annis

(57) ABSTRACT

This invention provides a face decoration mask which makes two stand racks easy to extend, fold or stand still. The decoration mask includes the connection parts of first stand rack and second stand rack; this decoration mask is designed with strand space on the eyes of face, and there are ridges on two sides; the opposite side of ridges is corresponding grooves; on the one side of said first and second stand rack, there is a holding extend from connection part to users' ears and set on the face for decoration; on the other side of connection part, there is an end part, which extend from the connection part to make bowl-like shape and buckle into groove to make first and second rack stand still.

5 Claims, 13 Drawing Sheets

(B) (A)

INVENTED FACE DECORATION MASK

FIELD OF THE INVENTION

This invention involves a particularly light mask decoration, used in ceremony, celebration, drama, and masquerade.

DESCRIPTION OF PRIOR ARTS

The prior art of decoration masks are used to put on the users' faces for cover with two sides of brace cords, but the disadvantages are that users will have pressure on faces, breath obstructions, bad influence of eyesight. Thus, the prior art of decoration masks are not suitable for faces of long hours.

In addition, the brace cords are bundled on hair and easy to ruin the users' hairstyles. Moreover, whenever the prior art of decoration masks are taken off, it is easy to pull the hair.

Thus, this invention is to reach the goal of easy to put on and take off and free from facial pressure, hairstyle ruining, breath obstructions, and bad influence of eyesight. The inventor also wants to make this decoration masks easy to extend and fold and long hours of putting on faces.

SUMMARY OF THE INVENTION

In order to reach the goals above, this Face Decoration Mask invention is characteristic in that: A kind of light mask to cover the users' face with the plastic material of decoration mask (1);

with rivet (6*a*), going over decoration mask (1) on the right side of pivot hole (13) to make the angle of first stand rack (2) overturn;

with rivet (6*b*), which corresponds to first stand rack (2), going over first stand rack (1) on the left side of pivot hole (13) to make the angle of second stand rack (3) overturn;

said decoration mask (1) has strand space (11) on the eyes of face, and on the two sides of holding (4) there are ridge (12) protruding on the face; on the side part of ridge (12), there are groove (121) which are notch to decoration mask (1); on the two sides of pivot hole (13), there are corresponding ridge (12) and groove (121);

said first stand rack (2) and second stand rack (3) extend from connection part to conform to the head of users (100) on their ears, and set decoration mask (1) on the face with holding (4); said first stand rack (2) and second stand rack (3) extend from connection part to be bowl shape with hook to match with (4) and hook into groove (121) to make first stand rack (2) and second stand rack (3) fixed.

said first stand rack (2) and second stand rack (3) extend from connection part to conform to said holding (4) and hook into groove (121) to make first stand rack (2) and second stand rack (3) fixed with positioning part (5).

According to the description above, wherein said ridge (12) is extend from the end of decoration mask (1) to strand space (11) and along strand space (11) to the eyebrow end of decoration mask (1).

According to the description above, wherein said ridge (12) is on the two sides of decoration mask (1) and pivot hole (13) is in the middle part of ridge (12).

According to the description above, wherein said ridge (12) is two points like and distributed on two sides of decoration mask (1); pivot hole (13) is in the middle part of ridge (12).

According to the description above, wherein there is hole groove (71) on the inside part of first stand rack (2) and second stand rack (3) on the connection part of said decoration mask (1), and the middle part of hole groove (71) has a piercing (72); there is a rivet head (61) in hole groove (71), and piercing (72) corresponds to said pivot hole (13) to be pierced by rivet (6); rivet end (62) of rivet (6) is on the outside part of decoration mask (1).

According to the description above, wherein the connection part of said first stand rack (2) and second stand rack (3) is plate (8), and said positioning part (5) extends from plate (8) to be bowl like and extend to outside; end part (51) has to be over the end level of plate (8).

According to the description above, wherein said holding (4) extend from plate (8) and narrow down its width gradually to be a bending (41) hung on ears; said positioning part (5) extend from plate (8) and narrow down its width gradually and extend a little to be neck (52); holding (4) and positioning part (5) corresponds to each other.

According to the embodiment of above mentioned, this invention can reach the following effects:

1. In this invention, the first (2) and second (3) stand rack are connected to the left and right sides of decoration mask (1) to make the 360 degrees of overturn; when first (2) and second (3) stand rack extend, they can be used on users' head to clip on ears to avoid its pressure on faces for long hours of putting on; moreover, when first (2) and second (3) stand rack fold, it can save the spaces to keep, pack, and carry.

2. For decoration mask (1), when first (2) and second (3) stand rack extend, they are set steady without falling, with positioning part (5) buckle into the opposite side of ridge (12) in groove (121).

3. The ridge (12) of decoration mask (1) has the effects of enhancing without encountering the problem of deformation from hot or cold weather.

4. The first stand rack (2) and second stand rack (3) are used as glass to hang on ears to prevent from hair ruin, and free from the problem of pulling the hair when take off.

5. With rivet (6) to connect first (2) and second (3) stand rack of decoration mask (1), and rivet (6) is inserted inside part of hole groove (71) without protruding can reach the effect of beauty, safe, and comfort.

6. The above said positioning part (5) can have pressure to decoration mask (1) to make end part (51) buckle into groove (121) tightly; end part (51) is over plate (8) in groove (121) to be steady; moreover said neck (52) can make positioning part (5) elastically to help the buckle effect.

DETAILED DESCRIPTION OF THE PREFERRED EMBODIMENTS

The Detailed Description of the Preferred Embodiments according to the drawings are as follows:

FIG. 1 and FIG. 4 shows a kind of facial decoration, which includes:

A particularly light mask decoration, used in ceremony, celebration, drama, and masquerade on users (100)'s face (10) of decoration mask (1);

with rivet (6*a*), going over decoration mask (1) on the right side of pivot hole (13) to make the angle of first stand rack (2) overturn;

with rivet (6*b*), which corresponds to first stand rack (2), going over first stand rack (1) on the left side of pivot hole (13)to make the angle of second stand rack (3) overturn;

said decoration mask (1) has strand space (11) on the eyes of face, and on the two sides of holding (4) there are ridge (12) protruding on the face; on the side part of ridge (12), there are groove (121) which are notch to decoration mask (1); on the two sides of pivot hole (13), there are corresponding ridge (12) and groove (121);

said first stand rack (2) and second stand rack (3) extend from connection part to conform to the head of users (100) on their ears, and set decoration mask (1) on the face with holding (4).

said first stand rack (2) and second stand rack (3) extend from connection part to conform to said holding (4) and hook into groove (121) to make first stand rack (2) and second stand rack (3) fixed with positioning part (5).

Said decoration mask (1) is made with particular light plastic material; the outside of it can be painted with color, have decoration, flannel or any other items to make varieties for users' need.

Said first (2) and second (3) stand rack are on the left and right side of (1) to make 360 degrees of overturn with the center of rivet (6*a*) and rivet (6*b*) as FIG. 1 and FIG. 5 shows;

first (2) and second (3) stand rack can extend to put on as FIG. 4 and FIG. 9 shows; first (2) and second (3) stand rack can also fold forward to save space, and easy to pack, and keep.

FIG. 6 and FIG. 7 shows the section view of Y1-Y2 and Y2-Y2 as FIG. 5 shows; ridge (12) is outside part of decoration mask (1), and the opposite side of ridge (12) is located inside of groove (121); said first (2) and second (3) stand rack are set inside part of decoration mask (1); when positioning part (5) is buckled into groove (121), first (2) and second (3) stand rack will not shake or slide apart.

FIG. 8 shows the conceptual drawing in succession of FIG. 7; which shows that first (2) and second (3) stand rack has turned and make holding (4) is downward and positioning part (5) upward; when overturn, people have to use strong force to make positioning part (5) out of groove (121) and use mild force to overturn first (2) or second (3) stand rack; thus, people have to use strong force to make positioning part (5) into groove (121); from FIG. 6, it is clear that decoration mask (1) is round shape not flat; positioning part (5) will have scrape with decoration mask (1) when it overturn to go into groove (121).

FIG. 10 is the Z-Z section view of FIG. 9; when first (2) and second (3) stand rack fold, positioning part (5) will buckle into groove (121) to make first (2) or second (3) stand rack steady.

Said ridge (12) of decoration mask (1) has the effects of enhancing without encountering the problem of deformation from hot or cold weather.

The embodiment of ridge (12), as FIG. 1 and FIG. 5 shows said ridge (12) is extend from the end of decoration mask (1) to strand space (11) and along strand space (11) to the eyebrow end of decoration mask (1). As FIG. 11 and FIG. 12 shows, ridge (12) is on two sides of decoration mask (1) and rivet (6*b*) is in the middle part of ridge (12). As FIG. 13 and FIG. 14 shows, said ridge (12) is two points like and distributed on two sides of decoration mask (1); pivot hole (13) is in the middle part of ridge (12). Decoration mask (1) is particular light plastic material, when decoration mask (1) is made in shape, ridge (12) is also made in shape at the same time and vice versa; it is easy to make whether in which ways.

As FIG. 2 and FIG. 6 shows, first (2) and second (3) stand rack are set with rivet (6*a*) and rivet (6*b*), and the inside part of hole groove (71), there are first (2) and second (3) stand rack; piercing (72) is in the middle part of hole groove (71); said hole groove (71) with rivet head (61) inside without protruding, so it is good to view and free from the pressure to face; hole groove (71) corresponds to pivot hole (13) with rivet (6) piercing; rivet end (62) is on outside part of decoration mask (1).

As FIG. 15 shows, said first stand rack (2) and second stand rack (3) extend from connection part to conform to the head of users (100) on their ears, and set decoration mask (1) on the face with holding (4) to prevent from pressure on faces for long hours of putting on faces.

As FIG. 16 and FIG. 17 shows, decoration mask (1) is used as users'(100) front face (10) and is like a eye mask to decorate the users' (100) eyes and there is no glass on strand space (11) for users'(100) eyes (20) to observe; said ridge (12) and the opposite side of groove (121) are beautifully decorated with the steady function to decoration mask (1).

FIG. 18 and FIG. 19, which is different from FIGS. 16 and 17, shows the overlook of this invention and are totally cover of faces unless the forehead part; it is clear that this decoration mask (1) can make partial or full cover of users' face (10).

Said first (2) and second (3) stand rack are embodiment and the better embodiment is in FIG. 20; FIG. 20 shows that part A is the frontal view of first (2) and second (3) stand rack, and part B is the left side view, which shows that connection part of first (2) and second (3) stand rack are plate (8); hole groove (71) and piercing (72) are in the middle part of plate (8); said positioning part (5) extend from plate (8) with the angle of θ; the end part of end part (51) has to be over plate (8); spacing (L) is the distance over end part (51). Through positioning part (5), there is a bounce power to decoration mask (1) to make end part (51) buckle into groove (121) to over the end of end part (51) of plate (8) to the function of steady.

Moreover, said holding (4) extend from plate (8) and narrow down its width gradually to be a bending (41) hung on ears; said positioning part (5) extend from plate (8) and narrow down its width gradually and extend a little to be neck (52); holding (4) and positioning part (5) corresponds to each other. Said neck (52) can have better bounce effect with positioning part (5) to have less rigidity.

The embodiments mentioned above are not limited by drawings; any invention confers to the idea above or little change belongs to this invention.

BRIEF DESCRIPTION OF THE DRAWINGS

FIG. 15: shows the overlook of users' put on.

Figure 1:
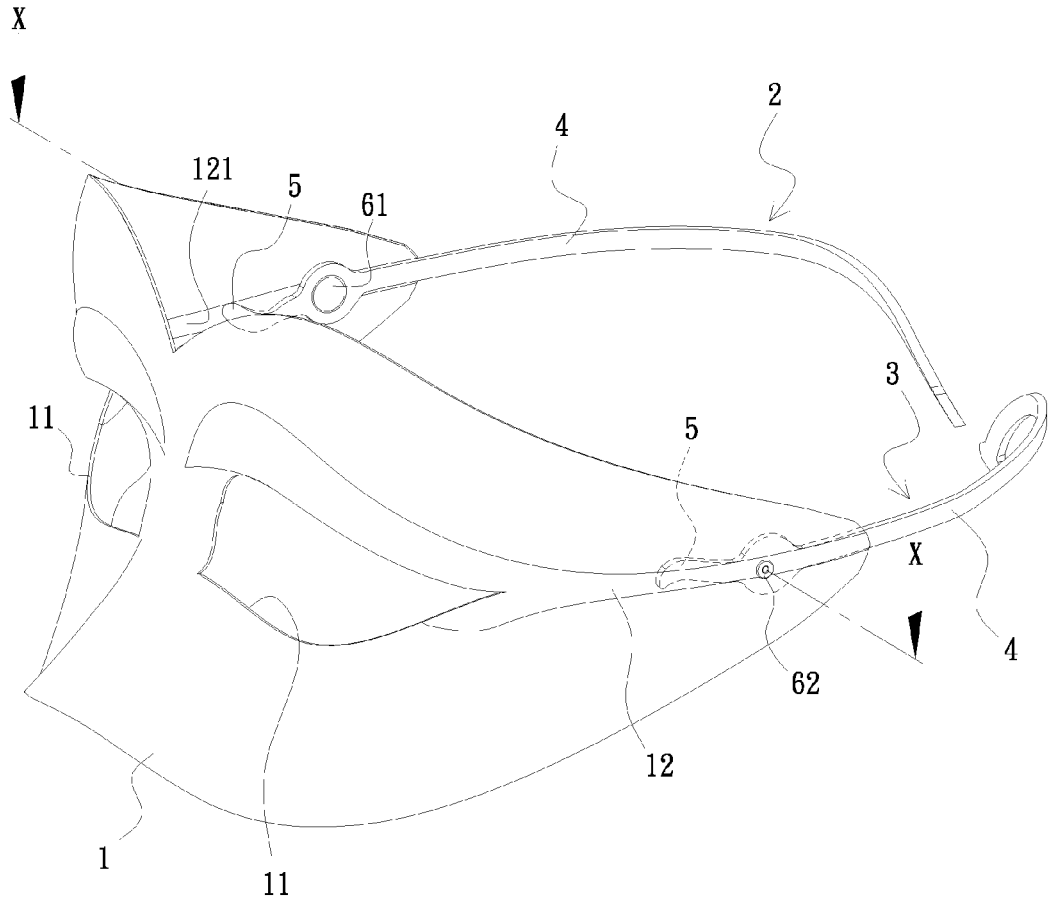
FIG. 1: shows the first embodiment of 3-Dimensional assembly drawing.
Figure 2:
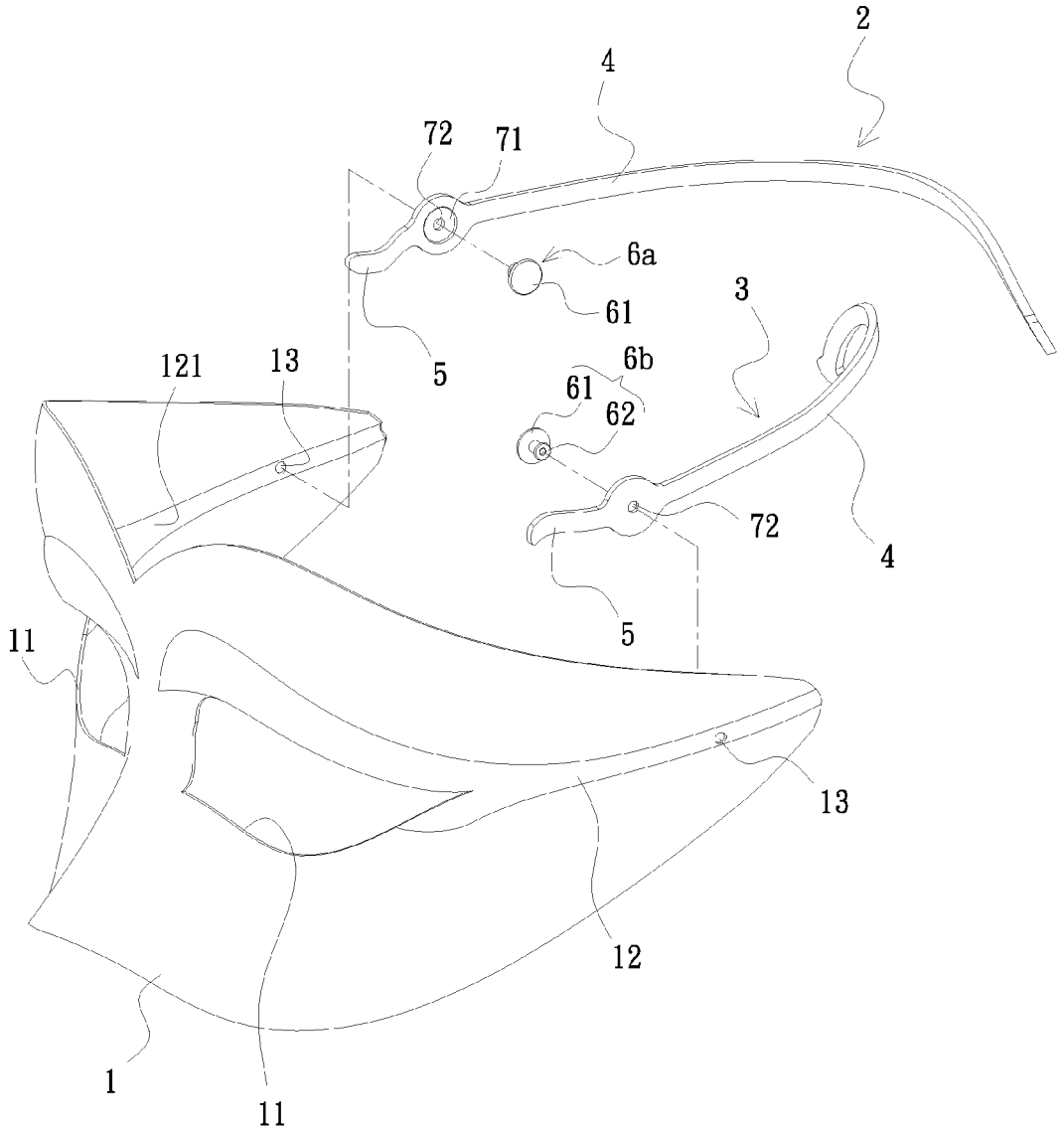
FIG. 2: shows the FIG. 1 of 3-Dimensional decomposition drawing.
Figure 3:
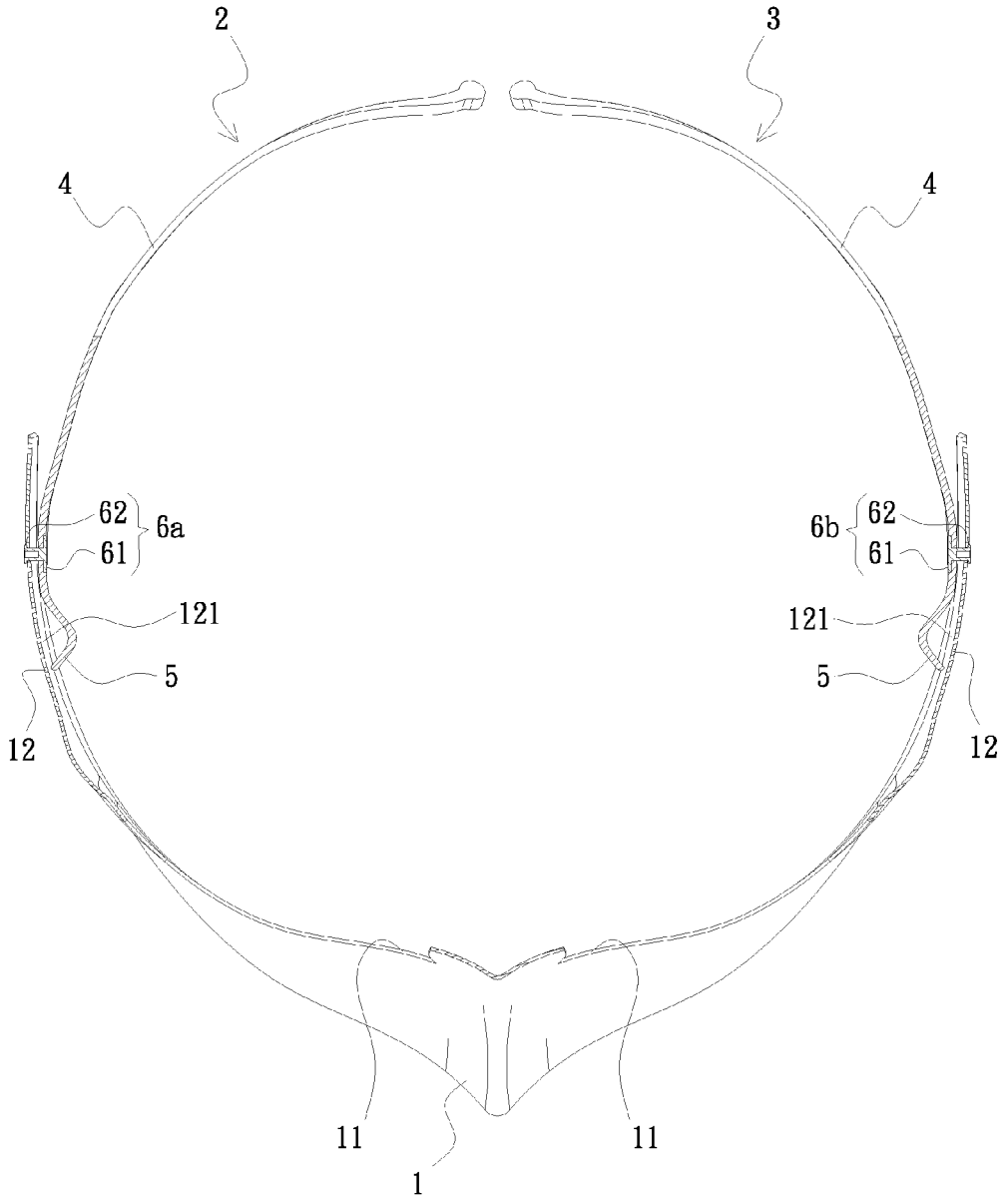
FIG. 3: shows the FIG. 1 of X-X cross section conceptual drawing.
Figure 4:
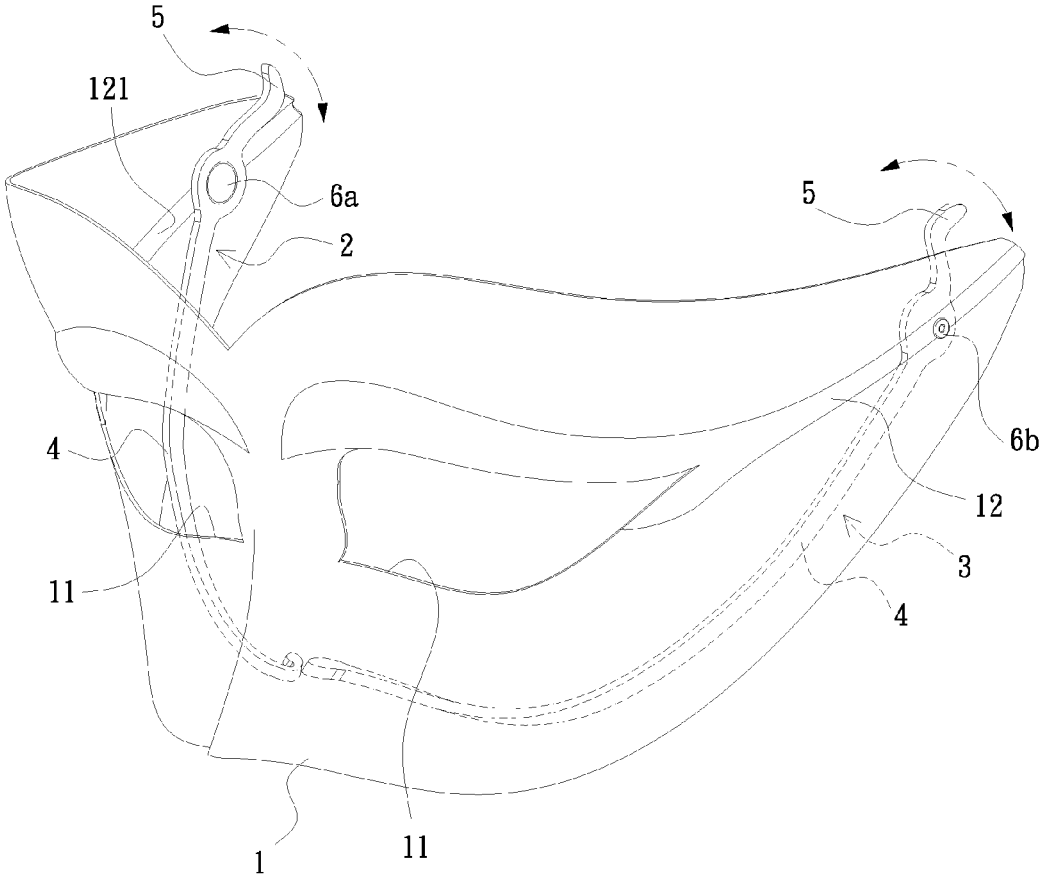
FIG. 4: shows the FIG. 1 of first and second stand rack 3-Dimensional drawing after folded.
Figure 5:
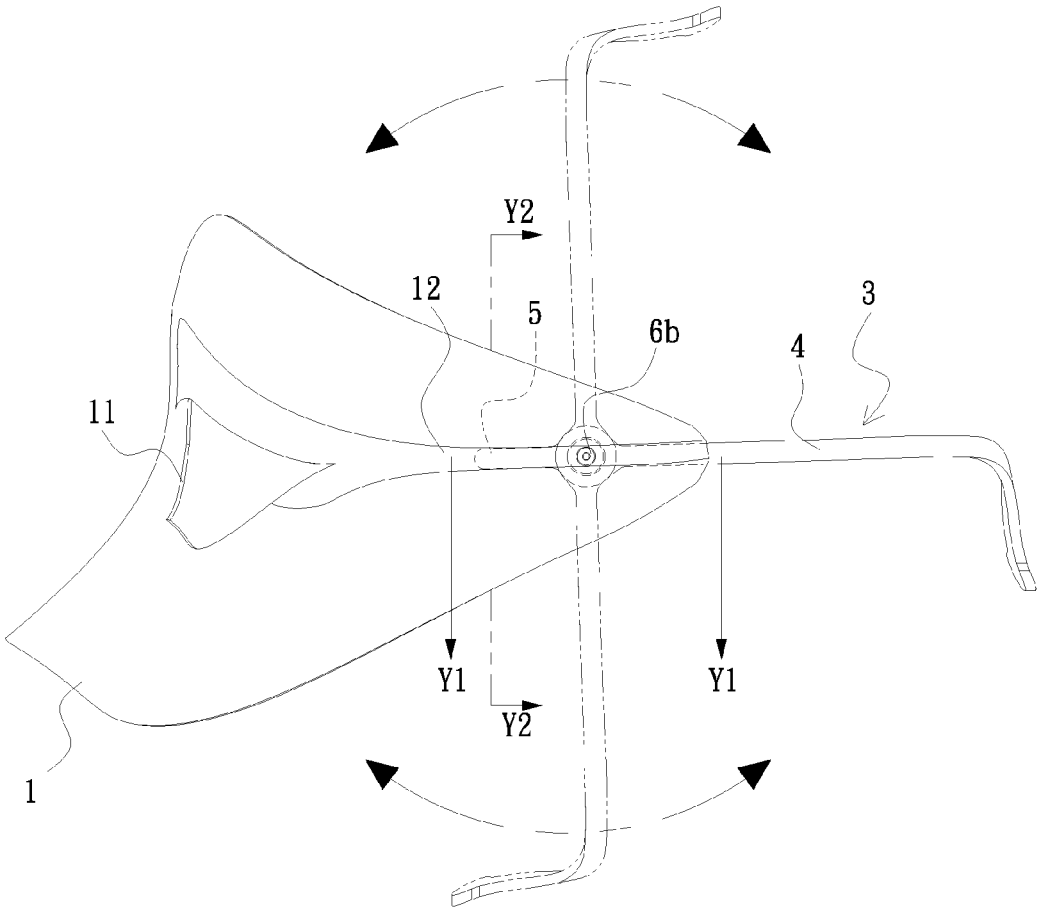
FIG. 5: shows the right view of extended part of stand rack of FIG. 1.
Figure 6:
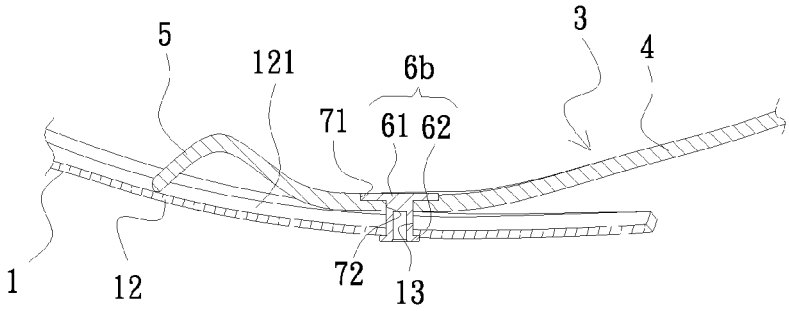
FIG. 6: shows the Y1-Y1 section view of FIG. 5.
Figure 7:
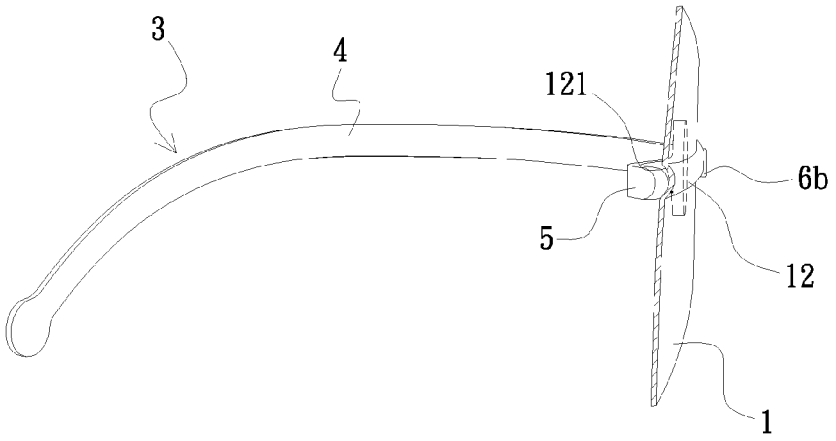
FIG. 7: shows the Y2-Y2 section view of FIG. 5.
Figure 8:
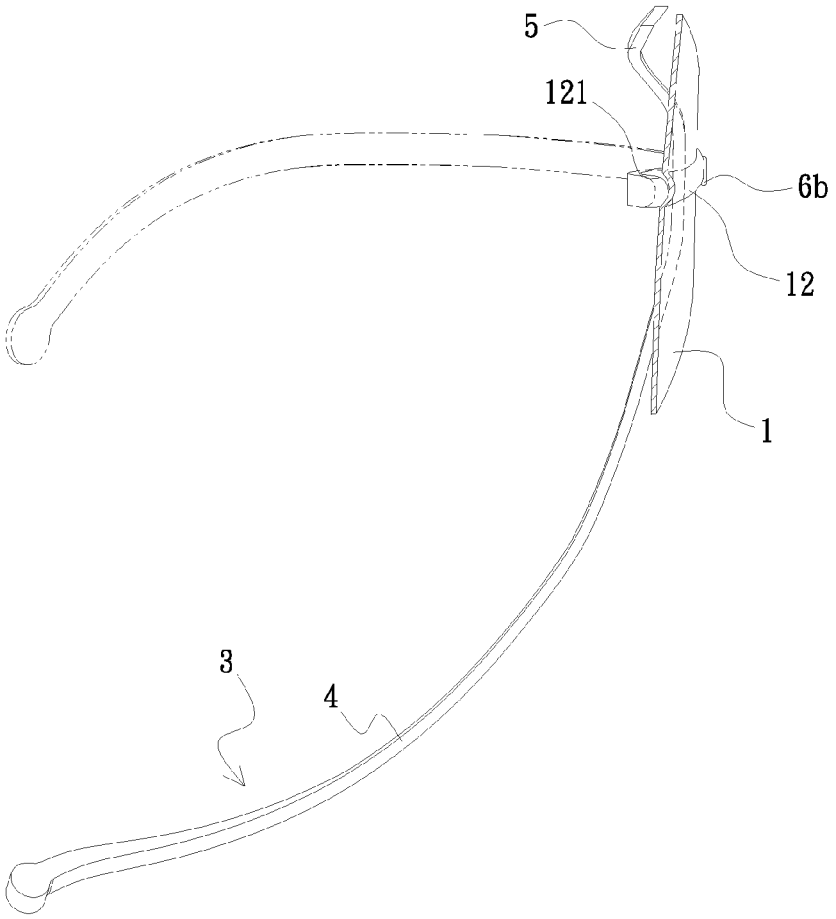
FIG. 8: shows the conceptual drawing of stand rack after overturn in connection with FIG. 7.
Figure 9:
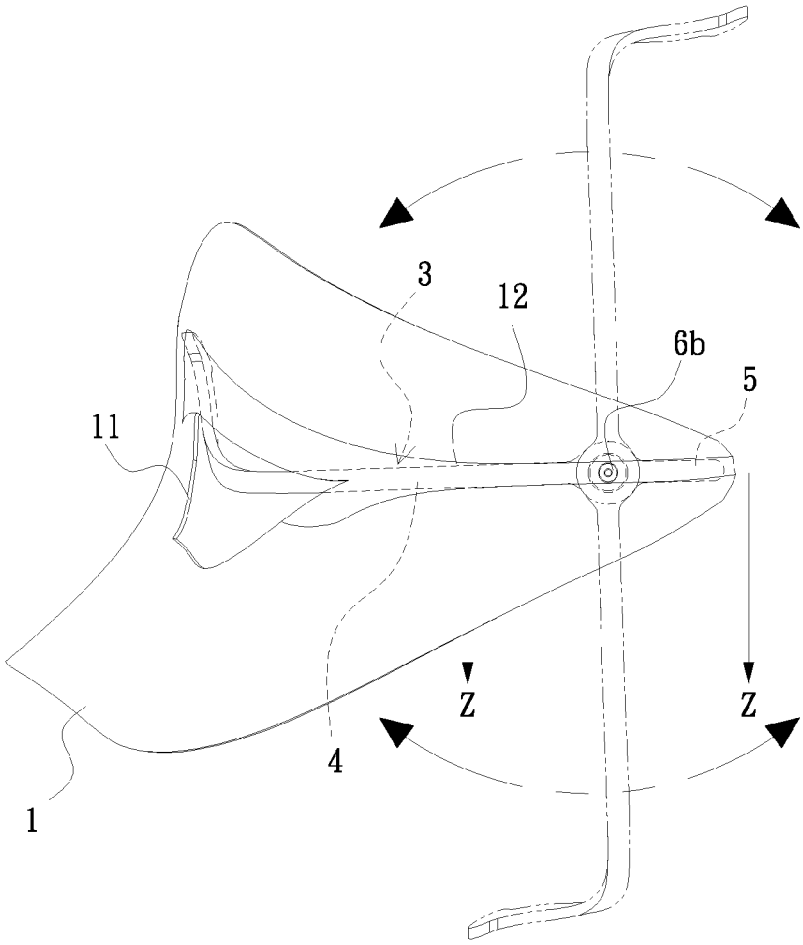
FIG. 9: shows the right view of FIG. 1 after stand rack folded.
Figure 10:
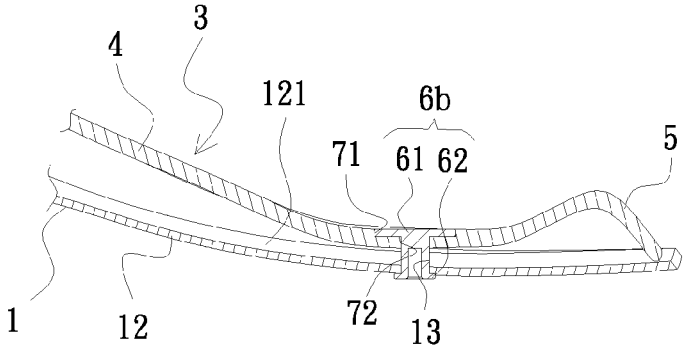
FIG. 10: shows Z-Z section view of FIG. 9.
Figure 11:
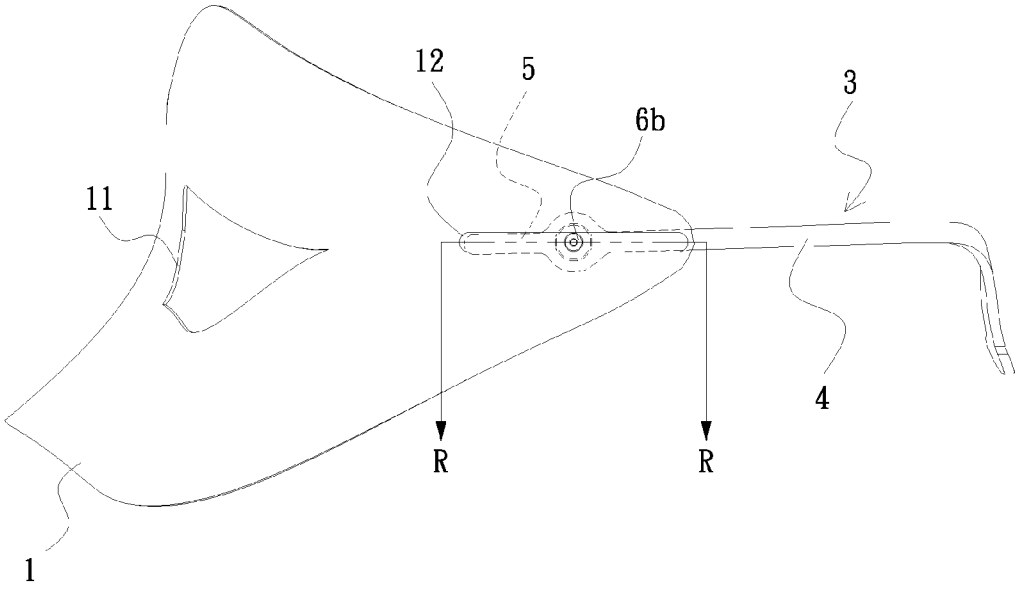
FIG. 11: shows the right view of second embodiment.
Figure 12:
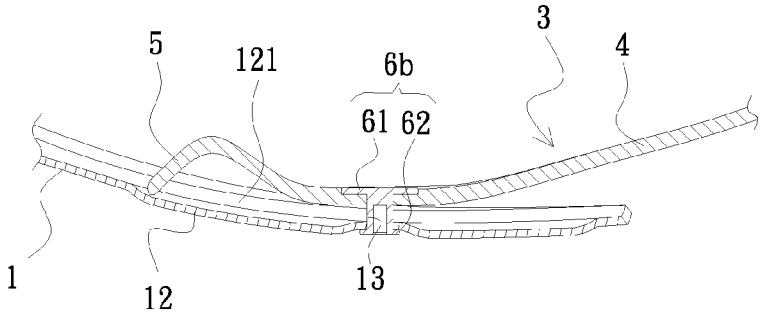
FIG. 12: shows the R-R section view of FIG. 11.
Figure 13:
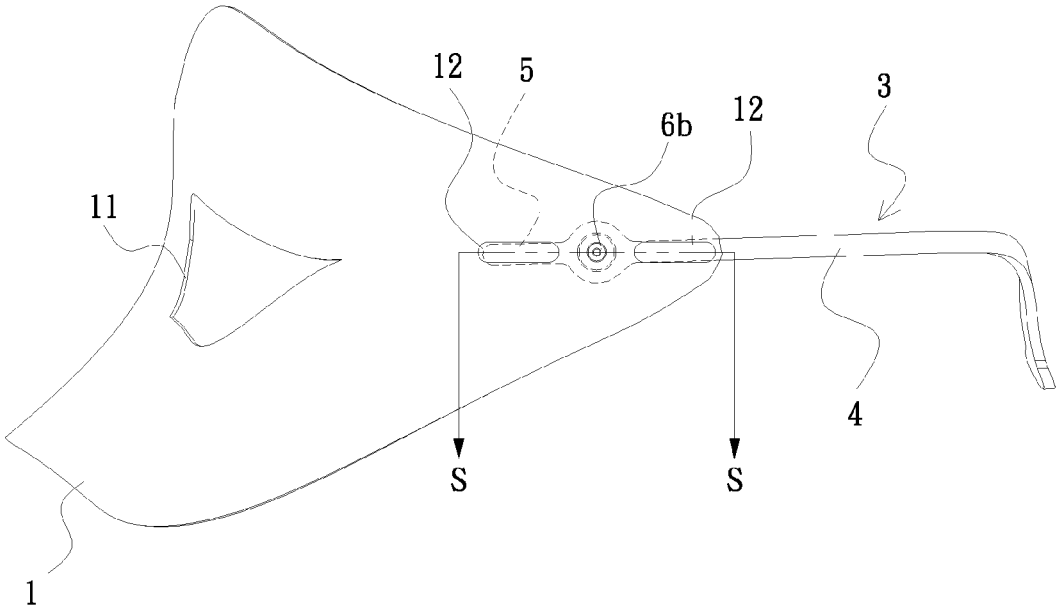
FIG. 13: shows the third embodiment of right view.
Figure 14:
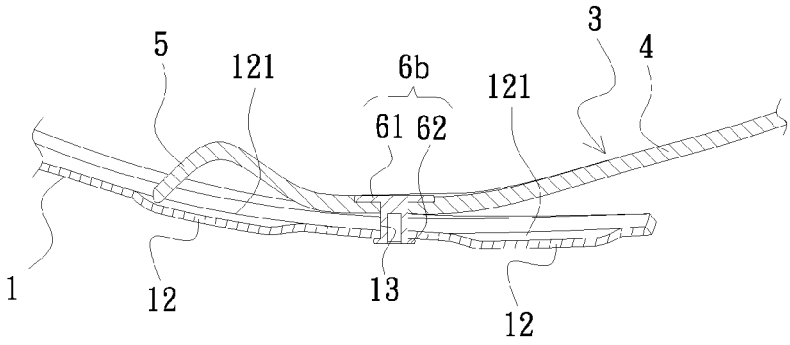
FIG. 14: shows the S-S section view of FIG. 13.
Figure 15:
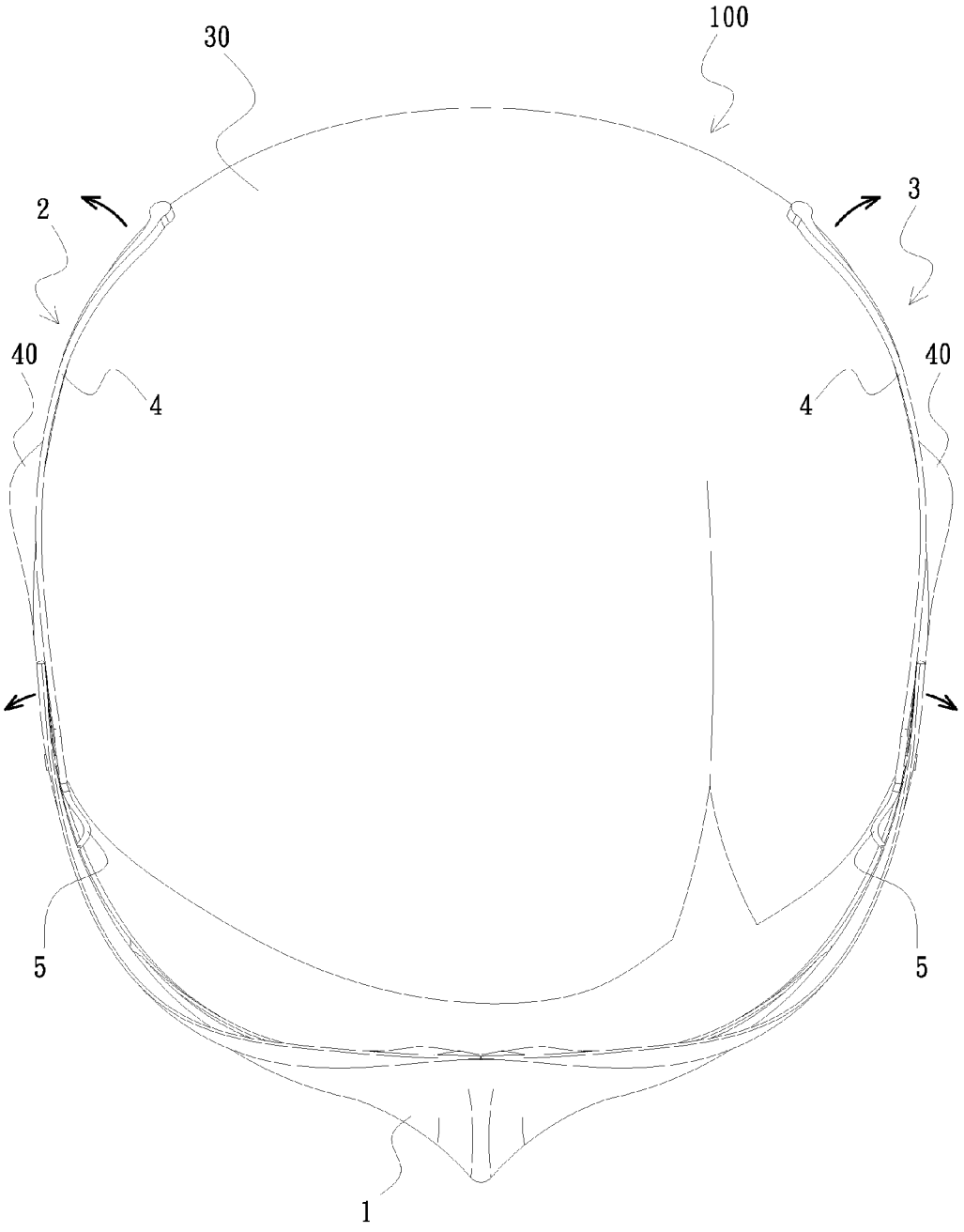
Figure 16:
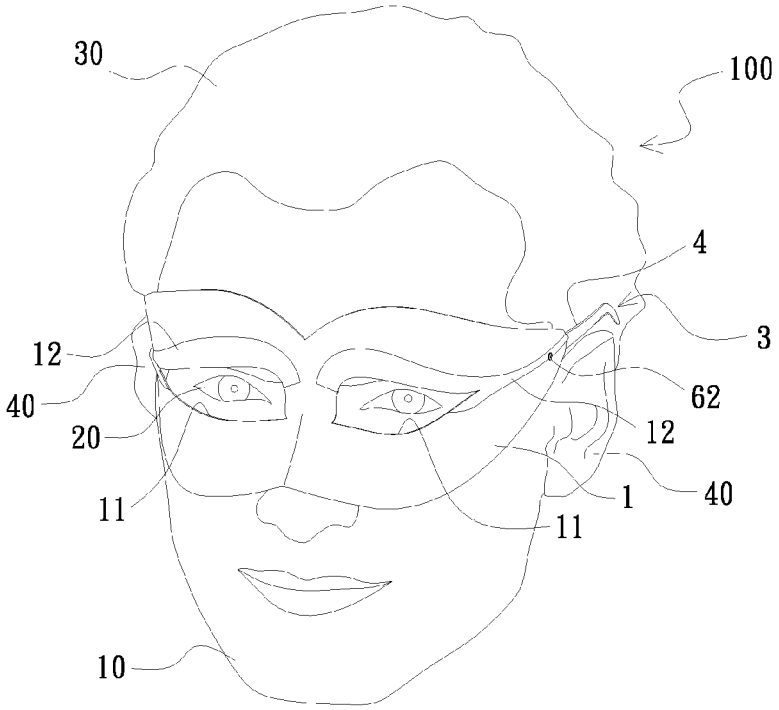
FIG. 16: shows the conceptual drawing of users' put on of the first embodiment.
Figure 17:
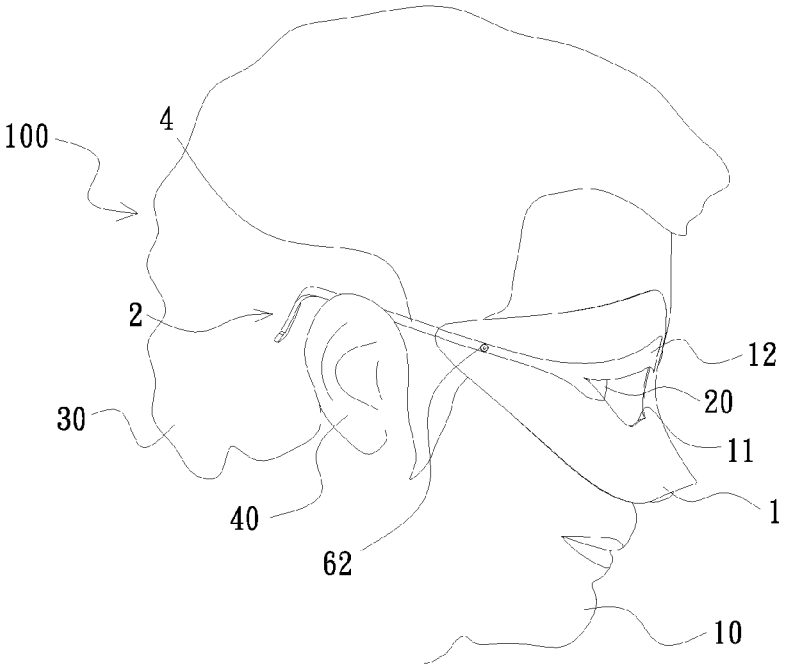
FIG. 17: shows the left side of section view of FIG. 16.
Figure 18:
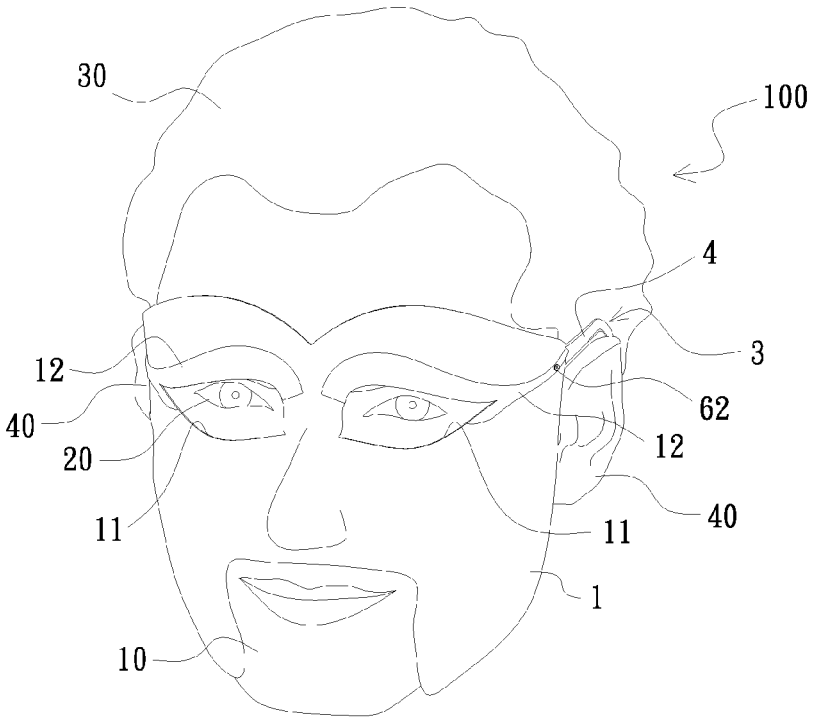
FIG. 18: shows the overlook of users' put on of second embodiment.
Figure 19:
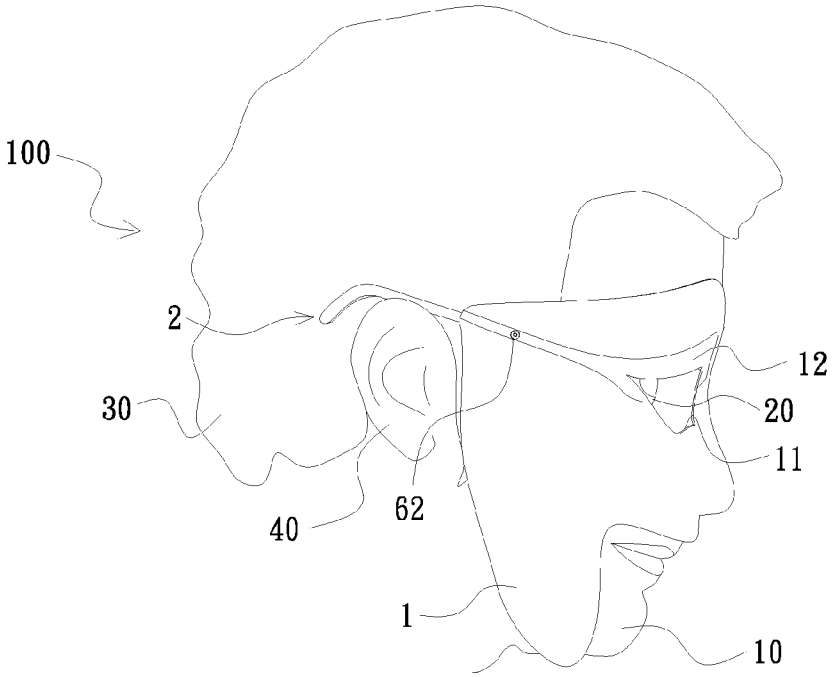
FIG. 19: shows left side of section view of FIG. 18.
Figure 20:
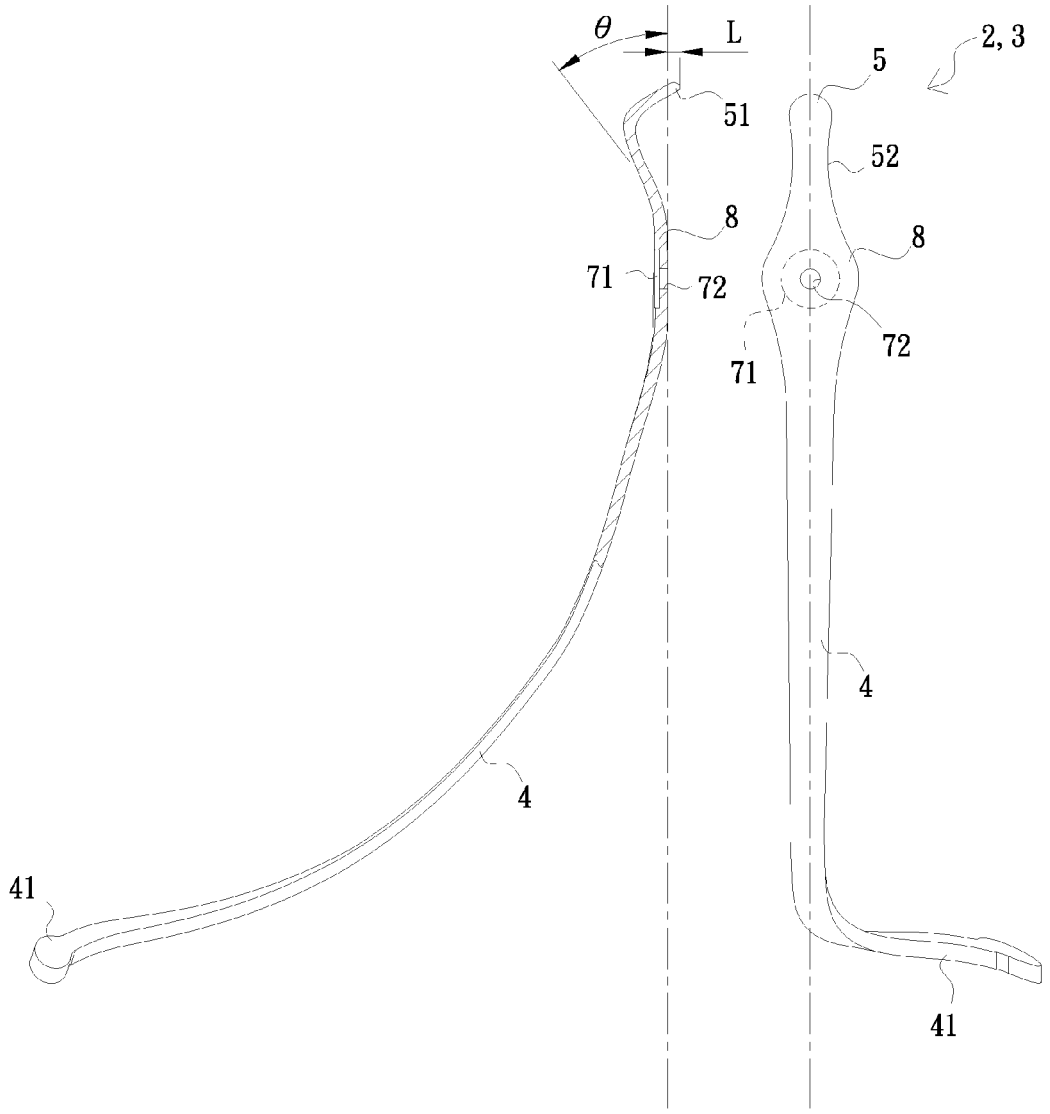
FIG. 20: shows right and left side of stand rack.

I claim:

1. A light decoration mask made with plastic for covering a user's face comprising:

a decoration mask (1) having first and second pivot holes (13);

a first arm (2) and a second arm (3) adapted to hang the first and second arms on the ears of the wearer when worn, and connected pivotally to said decoration mask (1) by first and second rivets (6*a*, 6*b*) which are fixed by and inserted into the first and second pivot holes (13) to support said decoration mask (1), the first and second arms (2), (3) including positioning parts (5) protruding from holding portions (4) of the first and second arms (2), (3) which are moveable upward and downward;

said decoration mask (1) further including two apertures (11) adapted to the eyes of the wearer, ridges (12) arranged in two outer sides of the decoration mask (1) and protruded outwardly thereof, and grooves (121) arranged inside the decoration mask (1) and corresponded to the ridges (12), the grooves (121) configured to fix the positioning parts (5);

wherein the holding portions (4) of the first arm (2) and the second arm (3) are configured to suit for the head size of users (100) on their ears, and to settle the decoration mask (1) on the face;

and wherein said positioning parts (5) are moveable into said grooves (121) to prevent movement of the first arm (2) and the second arm (3) relative to the decoration mask (1);

connection parts respectively arranged in said first arm (2) and said second arm (3) defining round flat plates (8); wherein said positioning parts (5) are extended. from the round flat plates (8) and hunched inwardly, and then extended outwardly to end parts (51); wherein the end parts (51) of the positioning parts (5) are beyond a horizontal surface of the round flat plates (8);

wherein said holding portions (4) are extended from the round flat plates (8) and bent inwardly to form bending parts (41) adapted to hang on the ears of the wearer; wherein said positioning parts (5) are extended from the round flat plates (8) and then gradually narrowed in both sides thereof to the end parts (51) to form necks (52); wherein the holding portions (4) and the positioning parts (5) are corresponded to each other.

2. The light decoration mask (1) as claimed in claim 1, wherein said ridges (12) extend from ends of decoration mask (1) to the apertures (11) and along the apertures (11) to an eyebrow end of the decoration mask (1).

3. The light decoration mask (1) as claimed in claim 1, wherein said ridges (12) are on the two outer sides of the decoration mask (1) and the pivot holes (13) are in middle parts of the ridges (12).

4. The light decoration mask (1) as claimed in claim 1, wherein said ridges (12) includes two points and are distributed on two sides of the decoration mask (1); the pivot holes (13) are in the middle parts of the ridges (12).

5. The light decoration mask (1) as claimed in claim 1, wherein pivotal connection parts respectively disposed in the first arm (2) and the second arm (3) are provided with round grooves (71) therein, the round grooves (71) having through holes (72) arranged in a circle center thereof; wherein rivet heads (61) are positioned in the round groove (71), and the through holes (72) corresponding to said pivot holes (13) are inserted through rivets (6), rivet ends (62) of the rivets (6) disposed on an outer face of the decoration mask (1).

* * * * *